United States Patent [19]

Vogel

[11] 4,441,862

[45] Apr. 10, 1984

[54] SYNCHRONIZED MIXING PUMP

[75] Inventor: Benjamin Vogel, Encino, Calif.

[73] Assignee: Haskel, Inc., Burbank, Calif.

[21] Appl. No.: 328,072

[22] Filed: Dec. 7, 1981

[51] Int. Cl.[3] ..... F04B 17/00

[52] U.S. Cl. ..... 417/250; 417/264; 417/374; 417/397

[58] Field of Search ..... 417/250, 374, 397, 503, 417/259, 260, 264; 222/137, 134, 135; 137/99

[56] References Cited

U.S. PATENT DOCUMENTS

| | | | |
|---|---|---|---|
| 1,081,784 | 12/1913 | Spohrer | 417/397 X |
| 1,487,946 | 3/1924 | Johnston | 417/374 X |
| 4,037,616 | 7/1977 | Pinkerton | 417/250 X |
| 4,256,440 | 3/1981 | Kern | 417/503 X |

*Primary Examiner*—Leonard E. Smith

*Attorney, Agent, or Firm*—Fulwider, Patton, Rieber, Lee & Utecht

[57] ABSTRACT

A mixing pump includes a primary pumping chamber opposed by a secondary mixing chamber with primary and secondary pistons that are connected to each other and reciprocated in the chambers. Preferably, an actuator mechanism that drives the pistons is located between the chambers. An additive fluid is expelled from the secondary chamber through a mixing conduit into a mixing chamber where it is injected into a main fluid. The fluid mixture from the mixing chamber is then admitted to the primary pumping chamber from which it is expelled under pressure, preferably through an outlet valve in the primary piston. The fluid can be more thoroughly mixed as it passes through that valve and an annular passage surrounding this piston.

7 Claims, 2 Drawing Figures

SYNCHRONIZED MIXING PUMP

FIELD OF THE INVENTION

The present invention relates to pumps, and, more particularly, to pumps that are adapted to pump a mixture of fluids from two different sources.

BACKGROUND OF THE INVENTION

There are numerous situations in which it is necessary to pump a mixture of fluids from two different sources. Commonly, it is desirable to control the proportions of the mixture and to achieve thorough and uniform mixing of the fluids as they are pumped.

This type of two fluid mixing occurs in many environments. One common situation involves the mixing of soluble oil in water for use as a cooling fluid or a hydraulic fluid. The presence of oil has a corrosion-inhibiting effect. A ratio of 95 parts water to 5 parts oil is typical.

One known arrangement for pumping and mixing such fluids employs two pumps, with the mixing taking place downstream. It is, however, difficult to maintain the selected mixture proportion because the speed at which each pump operates will vary with the instantaneous resistance that it meets. Maintaining the proper adjustment as to the relative speeds of the pumps can become very difficult, particularly if the speeds of the pumps are to be varied from time to time. Moreover, the downstream mixing of the fluids may require additional components that impede the fluid flow and increase the resistance to pumping, even if the two pumps are mechanically connected by gears or otherwise to ensure the desired speed ratio.

An objective of the present invention is to provide a simple reliable mixing pump in which the proportion of two fluids being pumped and mixed remains constant and is independent of the aggragate rate at which the mixture is pumped. Another objective is to provide such a pump in which the fluids are thoroughly mixed as they are pumped. A still further objective is to supply a substantially even, pulse-free flow of the mixed fluids at any desired outlet pressure.

SUMMARY OF THE INVENTION

The present invention accomplishes the above objective by a pump that includes primary and secondary pumping chambers, each equipped with inlet and outlet valves, preferably check valves, by which fluid flow is controlled. These chambers can be arranged so that they oppose each other. Primary and secondary pistons reciprocate in the two chambers, respectively, the pistons being connected for joint movement.

Reciprocation of the secondary piston causes an additive fluid to be pumped from the secondary pumping chamber, through a mixing conduit, into a mixing chamber, where it is injected into a main fluid. The mixture is then drawn into the primary pumping chamber and expelled by movement of the primary piston while more thorough mixing takes place.

Preferably, the pistons reciprocate along a common linear axis. As the primary piston makes a first stroke to draw mixed fluid into the primary pumping chamber, the secondary piston makes its second stroke to expell the additive fluid from the secondary pumping chamber. Thus, the additive fluid is injected proportionately into a moving stream of the main fluid for improved mixing.

The mixed fluid can be emitted from the primary pumping chamber through a valve in the primary piston. It may then flow through an annular passageway surrounding the piston. This arrangement can provide a double action of the piston for increased turbulence, a more thorough mixing of the fluid, and a smoother fluid flow.

Reciprocation of the primary and secondary pistons is produced by an actuator mechanism that may be located between the primary and secondary pumping chambers. Preferably, it includes an actuation chamber in which a double-acting piston reciprocates along the same axis as the primary and secondary pistons.

These and other features and advantages of the present invention will become apparent from the following detailed description, taken in conjunction with the accompanying drawings, which illustrate by way of example, the principles of the invention.

DESCRIPTION OF THE PREFERRED EMBODIMENT

Figure 1:
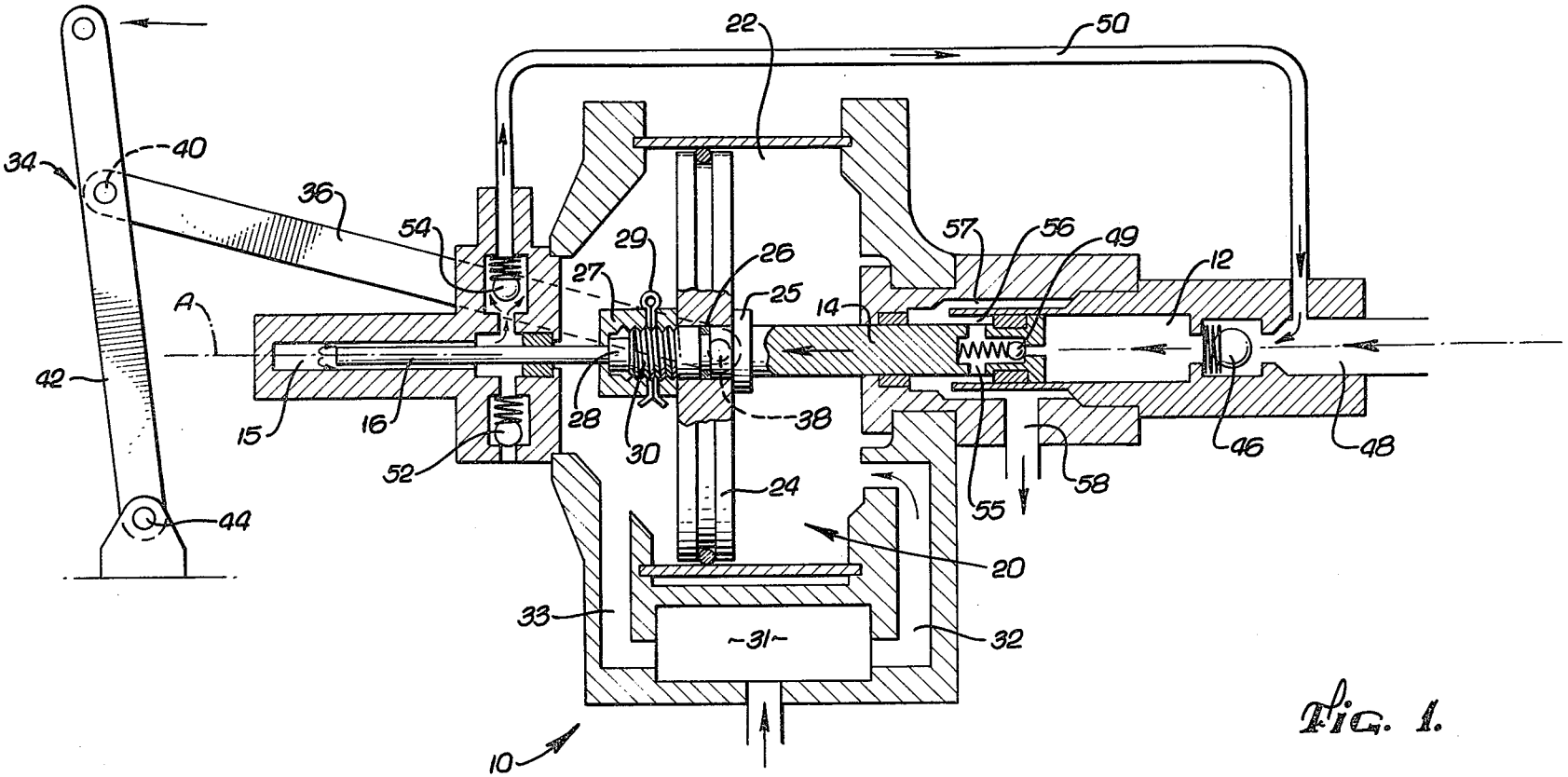
FIG. 1 is a cross-sectional view of a pump constructed in accordance with the invention in which fluid is being drawn from the mixing chamber into the primary pumping chamber.
Figure 2:
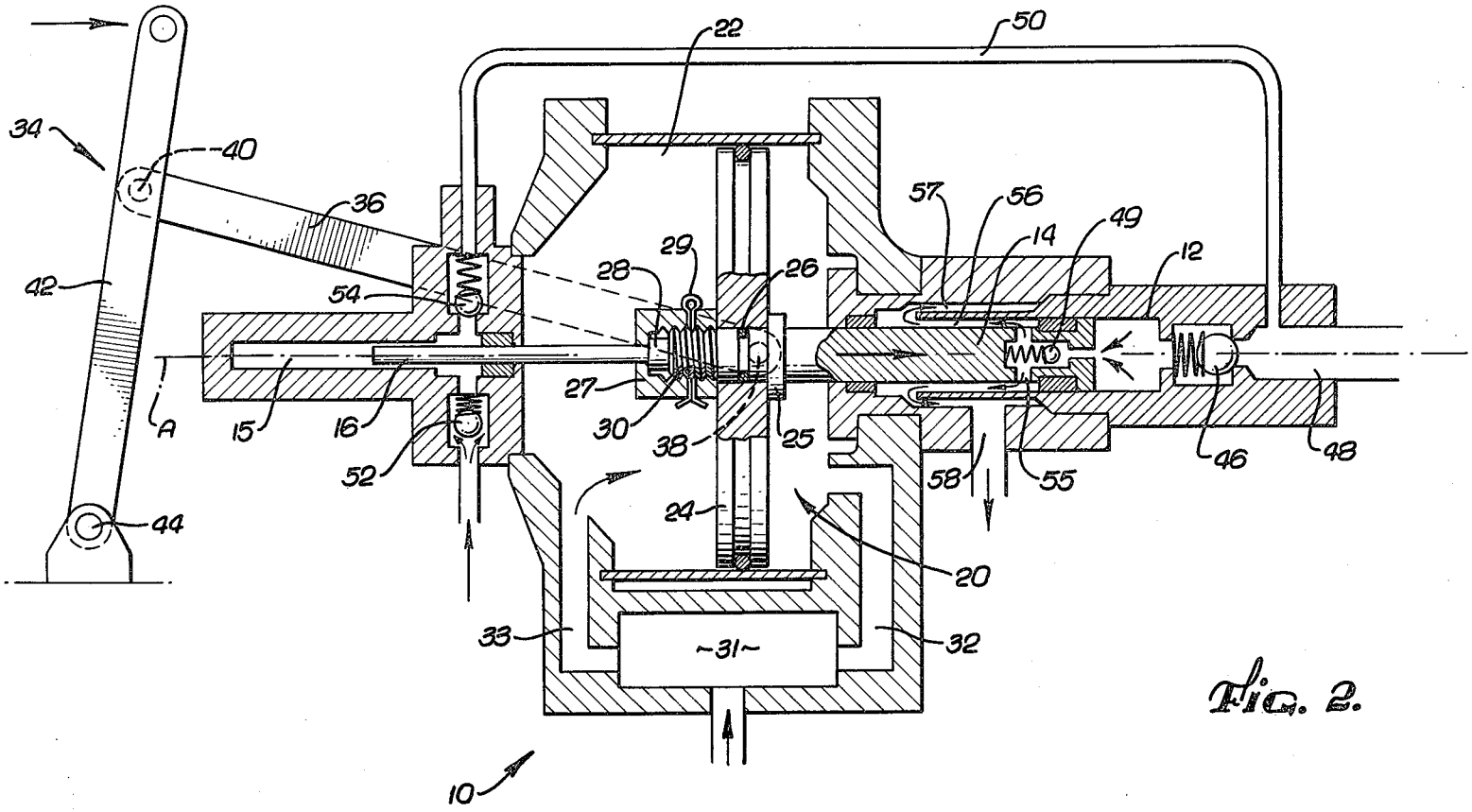
FIG. 2 is another cross-sectional view, similar to FIG. 1, showing the pump when the fluid is being expelled from the primary pumping chamber.

A pump 10 that is illustrative of the present invention, shown in FIGS. 1 and 2 of the drawings, includes a primary pumping chamber 12 in which a primary piston 14 is reciprocable and a secondary pumping chamber 15 in which a secondary piston 16 is reciprocable. The chambers 12 and 15 are cylindrical and oppose each other, being disposed along a common linear axis A. The secondary pumping chamber 15 is smaller than the primary pumping chamber 12, and the volume displaced by the secondary piston 16 is only a fraction of that displaced by the primary piston 14.

Disposed between the two pumping chambers 12 and 15 is an actuator mechanism 20 that includes a cylindrical actuation chamber 22 arranged along the same linear axis A. An actuation piston 24 reciprocates within the actuation chamber 22 on that axis A.

In this exemplary pump 10, the primary piston 14 which is rod shaped, is inserted axially through an aperture at the center of the much larger disc-shaped actuation piston 24. A flange 25 carried by the primary piston 14 engages a flat surface of the actuation piston 24, and a fluid seal 26 surrounds the primary piston within the opening in the actuation piston.

The secondary piston 16 is also rod-shaped and it is received and held captive at one end by a cup-shaped, threaded coupling 27 that receives an enlarged end 28 of the secondary piston. The coupling 27 is locked by a pin 29 to an end 30 of the primary piston 14 that projects through the actuation piston 24. The actuation piston 24 is thus sandwiched between the flange 25 and the coupling 27. This structural arrangement permits a small amount of articulation and independent piston movement to compensate for any unintended misalignment of the components.

The actuation mechanism 20 functions as a double-acting hydraulic cylinder. A conventional valve mechanism 31 (shown schematically) admits a pressurized drive fluid alternately at one end of the actuation chamber 22 through a passage 32, and then at the other end through a passage 33, thus causing the actuation piston 24 to reciprocate. This motion in turn causes simultaneous reciprocation of the primary and secondary pistons 14 and 16.

As an alternative mechanism for driving the pistons 14 and 16, a manual actuator 34 may be included in the pump 10. It includes a first drive lever 36 that is pivotably connected near one end 38 to the actuation piston 24 and at the other end 40 to an intermediate point on a second drive lever 42. At its lower end the second drive lever 42 is pivoted at a stationary point 44. Thus, the manual pivotal movement of the first drive lever 36 in one direction and then the other is translated into a reciprocation of the actuation piston 24 and hence the primary and secondary pistons 14 and 16.

Upon the movement of the pistons 14, 16 and 24 in a first direction, indicated in FIG. 1, the primary piston 14 is withdrawn from the primary pumping chamber 12. A mixture of fluids (such as oil and water) to be pumped is then admitted to the primary pumping chamber 12 through a first valve 46, which is an inlet valve of the ball and spring type. A poppet or plate-check valve may be used instead as the first inlet valve. A similar second valve 49 in the piston 14 that serves as an outlet valve remains closed.

The fluid that enters the primary pumping chamber 12 is drawn from an adjacent mixing chamber 48 formed by one end of a supply conduit through which a main fluid to be pumped is supplied. Of the two fluids being pumped, the main fluid (which may be water) is preferably the one pumped in the larger quantity.

The second fluid to be pumped (which may be oil), referred to here as an additive fluid, is supplied to the mixing chamber 48 from the second pumping chamber 15 through a mixing conduit 50. As the primary piston 14 is withdrawn from the primary pumping chamber 12, the secondary piston 16 moves into the secondary chamber 15. An inlet valve 52 by which additive fluid enters the secondary chamber 15 remains closed, and the additive fluid with which that chamber is filled is forced out through a fourth valve 54 into the mixing conduit 50. Thus, the additive fluid is injected to the mixing chamber 48 and is mixed with the main fluid as the fluid mixture is drawn into the primary pumping chamber 12.

Upon the completion of the movement of the pistons 14, 16 and 24 as described above, the flow of drive fluid into the actuation chamber 22 is redirected, causing the actuation piston 24 to move the primary and secondary pistons 14 and 16 in the opposite direction. The first valve 46 is then closed so that there is no further fluid flow into the primary pumping chamber 12. As the fluid mixture is emitted from that chamber 12 through the outlet valve 49 in the primary piston 14, it first passes radially through ports 55 into an inner annular passageway 56 between the piston 14 and the inside of the chamber wall, then back around the outside of the cylinder wall through an outer annular passage 57, and finally into a radial outlet passage 58. Simultaneously, the secondary pumping chamber 15 is refilled with additive fluid through the third valve 52. When the direction of piston movement is again reversed, a new charge of additive fluid is then proportionately injected into the mixing chamber 48 as the primary pumping chamber 12 is refilled.

The arrangement of the second valve 49 and surrounding structure should be noted. It is advantageous with respect to the pumping action itself since the fluid mixture is pumped on each stroke of the primary piston 14. When the piston 14 moves toward the first valve 46, fluid in the primary chamber 12 is displaced and forced through the outlet 58. Some fluid remains, however, in the annular passages 56 and 57. Upon the return stroke of the piston 14, fluid is forced from the inner annular passage 56. The dimensions of the piston 14 and chamber 12 are such that the chamber volume displaced by the piston 14 moving into the chamber is twice that of the inner passage 56 displaced by the piston on the next stroke. Thus, half the fluid displaced from the chamber 12 is emitted from the outlet 58 as the piston 14 moves into the chamber and the other half is displaced as the piston moves back out and the chamber is refilled. Since fluid is pumped by the movement of the piston 14 in both directions, the fluid flow is more uniform as is the demand on the power supply that drives the pump 10.

It should also be noted that the circuitous axial and radial flow of the fluid produces greater turbulence and more thorough mixing of the main and additive fluids. In addition, the additive fluid is injected into the mixing chamber only when the first valve 46 is open and there is a constant proportionate flow into the primary pumping chamber 12. The additive fluid cannot, therefore, accumulate in the mixing chamber making later downstream mixing with the main fluid more difficult.

While a particular form of the invention has been illustrated and described, it will be apparent that various modifications can be made without departing from the spirit and scope of the invention.

I claim:

1. A mixing pump comprising:

a primary pumping chamber;

a mixing chamber;

first valve means for admitting a mixture of a main fluid and an additive fluid from said mixing chamber to said primary pumping chamber;

second valve means for emitting said mixture from said primary pumping chamber;

a primary piston reciprocable in said primary pumping chamber for drawing said mixture into said primary pumping chamber through said first valve means on a first stroke and for expelling said mixture from said primary pumping chamber through said second valve means on a second and opposite stroke, said second valve means being disposed within said primary piston;

an annular passage surrounding said piston as said piston enters said primary pumping chamber;

an outlet passage for fluid emitted from said primary pumping chamber arranged to receive said fluid from said annular passage;

a secondary pumping chamber;

third valve means for admitting said additive fluid to said second pumping chamber;

fourth valve means for emitting said additive fluid from said secondary pumping chamber;

a secondary piston reciprocable in said secondary pumping chamber for drawing said additive fluid into said secondary pumping chamber through said third valve means on a first stroke and for expelling said additive fluid from said secondary pumping chamber through said fourth valve means on a second and opposite stroke;

mixing conduit means leading from said fourth valve means to said mixing chamber; and means for causing said primary and secondary pistons to reciprocate in synchronization such that said first stroke of said primary piston corresponds to said second stroke of said secondary piston and said second stroke of said primary piston corresponds to said first stroke of said secondary piston.

2. A mixing pump comprising:

a cylindrical primary pumping chamber;

a mixing chamber adjacent said primary pumping chamber;

first check valve means for admitting a mixture of a main fluid and an additive fluid from said mixing chamber to said primary pumping chamber;

second check valve means for emitting said mixture from said primary chamber;

a primary piston that carries said first check valve means reciprocable in said primary pumping chamber for drawing said mixture from said mixing chamber through said first valve means into said primary pumping chamber on a first stroke and for expelling said mixture from said primary pumping chamber through said second valve on a second and opposite stroke, said piston being dimensioned to define an annular passage surrounding said piston on the completion of said first stroke that is displaced by said piston on the completion of said second stroke, the volume of said annular passage displaced by said piston on said second stroke being one half the volume of said primary pumping chamber displaced by said piston on said first stroke;

a cylindrical secondary pumping chamber smaller than said primary pumping chamber, opposing said primary pumping chamber and aligned with said primary pumping chamber along a linear axis on which said primary piston reciprocates;

third check valve means for admitting said additive fluid to said secondary pumping chamber;

fourth check valve means for emitting said additive fluid to said secondary pumping chamber;

a mixing conduit leading from said fourth check valve to said mixing chamber;

a secondary piston reciprocable in said secondary pumping chamber for drawing said additive fluid into said primary pumping chamber through said third check valve means on a first stroke and for expelling said additive fluid from said secondary pumping chamber through said fourth valve means on a second and opposite stroke; and double-acting actuator means for causing said primary and secondary pistons to reciprocate in synchronization such that said first stroke of said primary piston corresponds to said second stroke of said secondary piston and said second stroke of said primary piston corresponds to said first stroke of said secondary piston, said actuator means comprising a cylindrical actuator chamber disposed between said primary pumping chamber and said secondary pumping chamber and an actuator piston reciprocable in said actuator chamber along said axis, said actuator piston being connected to said primary piston and said secondary piston for reciprocation therewith.

3. A mixing pump comprising:

a primary pumping chamber;

a mixing chamber;

first valve means for admitting a mixture of a main fluid and an additive fluid from said mixing chamber to said primary pumping chamber;

second valve means for emitting said mixture from said primary pumping chamber;

a primary piston reciprocable in said primary pumping chamber for drawing said mixture into said primary pumping chamber through said first valve means on a first stroke and for expelling said mixture from said primary pumping chamber through said second valve means on a second and opposite stroke, said second valve means being disposed within said primary piston;

an outlet passage for fluid emitted from said primary pumping chamber, said outlet passage being arranged to receive said fluid from an annular passage surrounding said primary piston as said primary piston enters said primary pumping chamber;

a secondary pumping chamber;

third valve means for admitting an additive fluid to said secondary pumping chamber;

fourth valve means for emitting said additive fluid from said secondary pumping chamber;

a secondary piston reciprocable in said secondary pumping chamber for drawing said additive fluid into said secondary pumping chamber through said third valve means on a first stroke and for expelling said additive fluid from said secondary pumping chamber through said fourth valve means on a second and opposite stroke;

mixing conduit means leading from said fourth valve means to said mixing chamber; and actuator means for causing said primary piston and said secondary piston to reciprocate, thereby pumping and mixing said main and additive fluids.

4. The mixing pump of claim 3 wherein:

said primary pumping chamber and said mixing chamber oppose each other; and said primary piston and said secondary piston are connected to each other for joint reciprocation, whereby said first stroke of said primary piston corresponds to said second stroke of said secondary piston and said second stroke of said primary piston corresponds to said first stroke of said secondary piston.

5. The mixing pump of claim 3 wherein:

said primary pumping chamber and said secondary pumping chamber are substantially aligned with each other; and said primary piston and said secondary piston reciprocate along a common axis.

6. The mixing pump of claim 3 wherein said actuator means is disposed between said primary pumping chamber and said secondary pumping chamber.

7. The mixing pump of claim 6 wherein said actuator means comprises an actuation chamber and an actuation piston reciprocable therein.

* * * * *